United States Patent [19]

Diamond et al.

[11] 4,288,519

[45] Sep. 8, 1981

[54] DUAL PURPOSE ELECTROPHOTOGRAPHIC MAGNETIC TONER AND PROCESS OF MAKING

[75] Inventors: Arthur S. Diamond, Ventura; Sydney N. Floersheim, Encino, both of Calif.

[73] Assignee: Black Copy Company, Inc., Canoga Park, Calif.

[21] Appl. No.: 862,613

[22] Filed: Dec. 20, 1977

Related U.S. Application Data

[62] Division of Ser. No. 772,502, Feb. 28, 1977.

[51] Int. Cl.[3] ..... G03G 9/08; B28B 11/06

[52] U.S. Cl. ..... 430/137; 430/110; 430/111; 264/12; 264/13; 264/74; 264/131

[58] Field of Search ..... 252/62.1 R, 62.1 P, 252/62.1 L; 427/22; 428/407; 264/7, 12, 13, 74, 131; 430/110, 137, 111

[56] References Cited

U.S. PATENT DOCUMENTS

| | | | |
|---|---|---|---|
| 3,196,032 | 7/1965 | Seymour | 252/62.1 P |
| 3,278,439 | 10/1966 | Blanchette et al. | 252/62.1 P |
| 3,639,245 | 2/1972 | Nelson | 252/62.1 P |
| 3,655,374 | 4/1972 | Palemiti | 252/62.1 P |
| 3,740,334 | 6/1973 | Jacknow | 252/62.1 P |
| 3,788,994 | 1/1974 | Wellman et al. | 252/62.1 P |
| 4,027,048 | 5/1977 | Crystal | 252/62.1 P |

FOREIGN PATENT DOCUMENTS

| | | | |
|---|---|---|---|
| 50-140136 | 10/1975 | Japan | 252/62.1 P |
| 1029182 | 5/1966 | United Kingdom | 252/62.1 P |

OTHER PUBLICATIONS

Shaffert, Electrophotography, Halsted Press, 1975, p. 69.

*Primary Examiner*—John D. Welsh
*Attorney, Agent, or Firm*—Marvin E. Jacobs

[57] ABSTRACT

A free-flowing, non-spherical, fragmentary, toner particle is prepared by blending a mixture of thermoplastic resins with magnetic iron oxide. The dispersion is processed to a fine powder and dry blended with conductive carbon black which is anchored onto the surface of the particle by warm air or gas.

9 Claims, 3 Drawing Figures

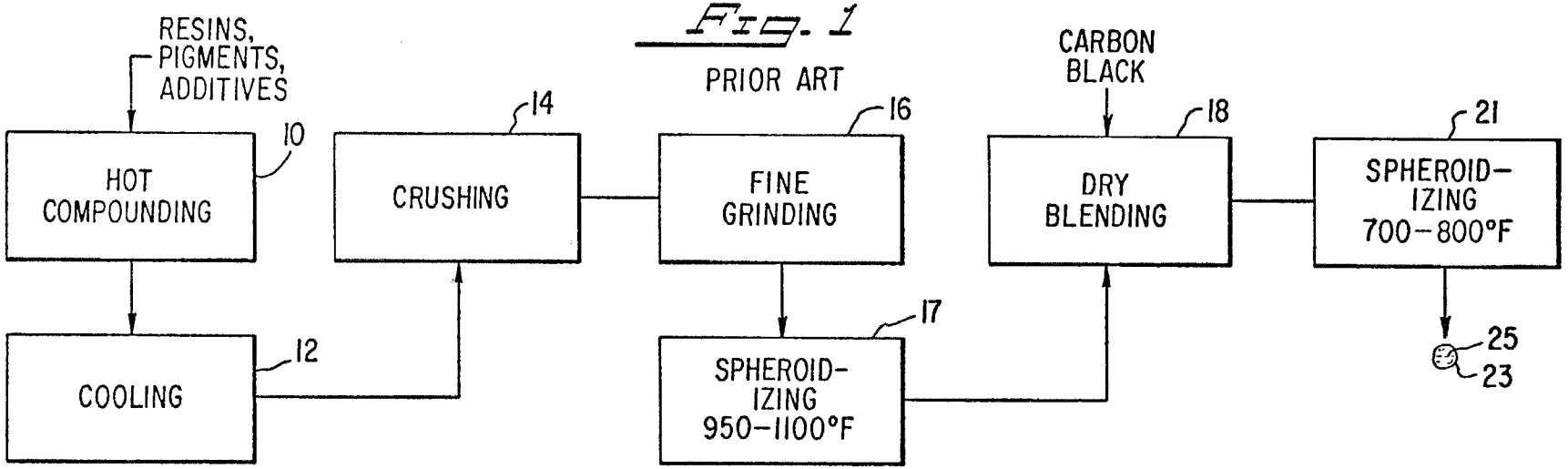
Fig. 1
PRIOR ART
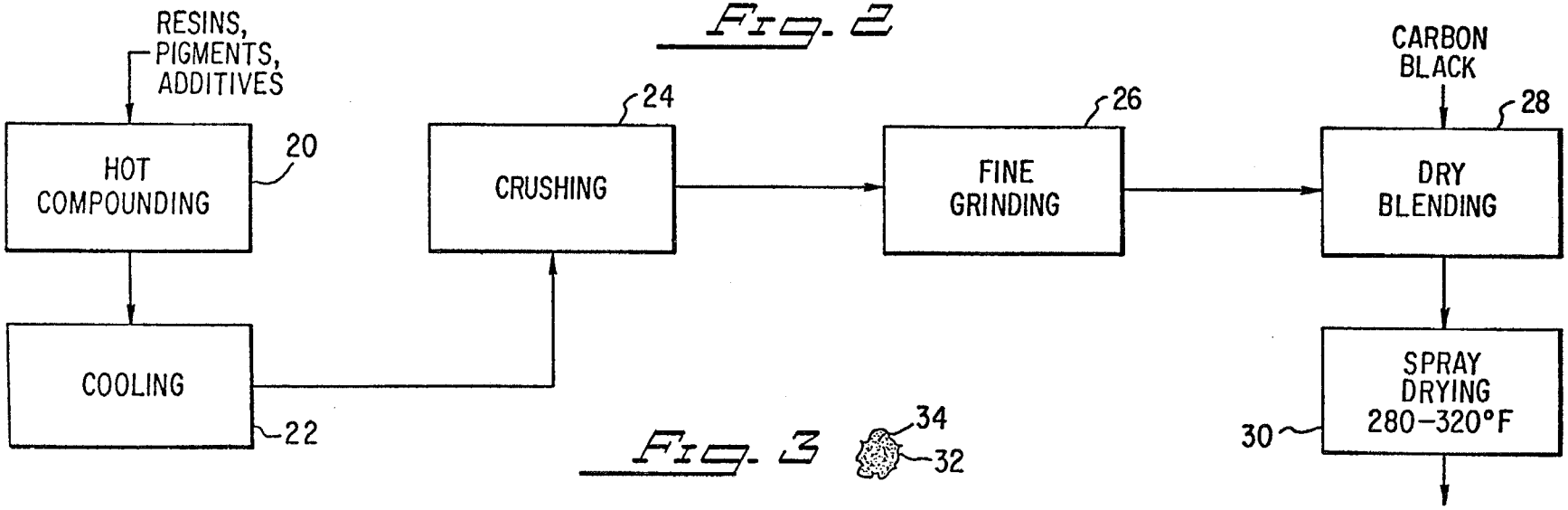
Fig. 2
Fig. 3

DUAL PURPOSE ELECTROPHOTOGRAPHIC MAGNETIC TONER AND PROCESS OF MAKING

This is a division of application Ser. No. 772,502 filed Feb. 28, 1977.

BACKGROUND OF THE INVENTION

1. Field of the Invention

The present invention relates to electrostatic and magnetic developing toners and more to a dual purpose toner useful in pressure fixing and/or thermal fixing development of latent images.

2. Description of the Prior Art

The function of toners in electrostatic reproduction is to be attractable by and adhere to an electrostatic image to form an initial visible image. More permanent adherence of the toner powder is attained by means of various fixing processes including heat and pressure. Early electrostatic developer mixes comprised a fine particle thermoplastic printing powder physically blended with a coarser charging medium called a "carrier." The carrier substance served to charge the printing particles by contact and provided a means to transport the toner to and from the development site. Recently, single-component toners have been introduced which are unchanged electrostatically in their normal state. The single component toner particles are electronically conductive and magnetically attractable. Electrostatic toner manufacturers are presently marketing two distinctly different single component toners; one for fixing by heat, or by a combination of heat and pressure, and a second type designed for fixing by the action of pressure alone.

The 3M VQC-1 Copier, for example, differs from other models in that it employs a combination of pressure and heat energy to fuse or fix toned images. On the other hand, 3M's VQC-II and VQC-III copiers use no heat for fixing. The latter machines depend solely upon a pair of highly polished steel rollers to physically calender or press the thermoplastic toner powder into the surface of the copy sheet. Substantial pressure is required to properly fix the image values of 150 to 200 pounds/inch have been reported.

U.S. Pat. No. 3,639,245 to Nelson and U.S. Pat. No. 3,925,219 to Strong describe a method of manufacturing toner in which the toner is compounded, finely ground and then spheroidized to produce particles that are essentially spherical in shape for use in the 3M VQC-I pressure and heat fixing machines. The actual products marketed by the 3M company (catalog no. 361 and 365) consist of particles that are truly spherical. Nelson at column 5, line 20 and Strong at column 4, line 50 disclose the use of a 700°–800° F. air stream which is at a temperature capable of at least softening and desirably melting the plastic resin.

Truly spherical particles can also be manufactured by spray drying, either by solvent spray drying or spray chilling. In solvent spray drying the toner resins are completely dissolved in a suitable solvent and then mixed with other dyes, pigments and additives. The dispersion is then pumped or fed by gravity to the top of a spray dryer. Upon entering the spray dryer the liquid mixture is atomized by dropwise feed onto a rapidly spinning disc, by passing through a specially constructed spray nozzle, or by other conventional means. The atomized cloud of fine liquid particles falls vertically downward into the main chamber of the spray dryer. A heated stream of air is fed at a 90° angle to the spray. Because it enters the cylindrical chamber tangentially, the air spirals down through the equipment in cyclone fashion. The swirling motion causes the particles to assume a spherical shape. In this respect, the spray dryer resembles a shot tower. Spray drying is expensive and unless fitted with a solvent recovery or incineration unit, is environmentally objectionable because of the large amounts of solvent vapors released to the environment.

SUMMARY OF THE INVENTION

A dual purpose, magnetic toner particle for use in electrostatic copying machines has been developed in accordance with the present invention. The toner particle exhibits excellent print quality, image density and temperature stability and has unusual versatility. It is the only single commercial toner performing well in both pressure and heat fixing copying machines. The toner exhibits good fixing either under high pressure or at relatively low fusing temperatures, yet it flows smoothly in powder form without caking, or bridging.

Furthermore, the toner particles are produced in accordance with the invention in a process eliminating the need for high temperature spheroidizing which reduces both the energy and equipment costs and the problem of safely eliminating the environmentally undesirable solvent vapors.

It is quite surprising and unusual that maximum image quality, print density and powder flow properties are produced in a nonspherical, fragmentary, or relatively sharp-edged particle. The performance of the nonspherical powder of the invention matches or exceeds the essentially spherical particles of the prior art and results in the great simplification of the manufacturing process. In the invention a unique combination of resins is employed as the thermoplastic material of the toner formulation. The resins employed are a mixture of a polyester resin and ethylene-vinyl acetate copolymer in a ratio of 1:1 to 5:1 preferably about 2:1 to 4:1 of polyester to ethylene-vinyl acetate copolymer. This special blend produces a material that bonds readily under the nip pressures encountered in pressure-fixing, electrostatic copiers and develops good adhesive properties, or tackiness at relatively low fusing temperatures. A ratio of 2.5 parts of polyester resin to 1 part of ethylene-vinyl acetate copolymer appears to be optimum.

Though it is not completely understood exactly why this particular resin combination has special physical and thermal characteristics it is believed that the ethylene-vinyl acetate copolymer lends extensibility to the blend, while the polyester resin provides excellent low temperature tack. Furthermore, the mixture of these materials could represent an eutectic composition that has unique tackifying qualities.

The toner of the invention is produced by the steps of blending the molten thermoplastic toner composition on conventional hot compounding equipment. After complete mixing and pigment dispersion, the material is cooled to a brittle solid, broken into large fragments and fed to a hammermill for coarse grinding. The granules are next ground to a fine powder having a weight average particle diameter in the range of 10–40 microns, preferably 8–20 microns. This fine grinding step is preferably carried out in a jet pulverizer. The powder must be a loose, free-flowing powder since good flowability is essential to its performance in an office copying machine as it guarantees uniform and steady replenishment of the magnetic brush applicator roll which carries out image development. The toner powder is then dry blended with a fine conductive black, one having a particle diameter in the range of 10–80 millimicrons (0.01 to 0.08 micrometers) in conventional powder mixing equipment. The amount of carbon black or other conductive pigment is between 0.5 and 2.0% on the weight of the dry toner.

The dry blend is still in the form of fragmentary, aspherical particles just as they were formed by the high impact pulverizing process.

After dry blending the toner-carbon black mixture is subjected to a heated gas stream, preferably air at a temperature just sufficient to soften the thermoplastic resin blend so as to permit the much finer, conductive carbon black powder to become firmly anchored to the surface of each toner particle. During this step the special combination of polyester and ethylene-vinyl acetate resins is important to assure excellent adhesion of the conductivizing pigment. The air stream is preheated to only 250°–350° F., preferably 280°–320° F., for the special resins utilized herein and in order to assure softening without flowing. If the air temperature exceeds about 330° F., the toner becomes much too tacky and adheres to the walls of the spray chamber, the duct work and the cyclone collector of the spray dryer. Hence, the process of the invention is inoperable under the conditions specified by the Nelson and Strong patents. Furthermore, since the process is operated at a lower temperature it produces a higher through-put of material and uses less energy. As a consequence of the lower temperature particles remain relatively unchanged in shape and retain the fragmentary appearance they acquired after being fractured in the jet pulverizing step.

These and many other features and attendant advantages of the invention will become apparent as the invention becomes better understood by reference to the following detailed description when considered in conjunction with the accompanying drawings.

BRIEF DESCRIPTION OF THE DRAWINGS

FIG. 1 is a schematic block description of a prior art process for producing spheroidizing single component toners;

FIG. 2 is a schematic block representation of the process of the invention; and FIG. 3 is an enlarged elevation view of a toner particle.

Referring now to FIG. 1, the prior art process described in the Stong and Nelson patents is exemplified. After hot compounding 10 of the resins, pigments and additives, the blend is cooled 12, crushed 14, fine-ground 16, subjected to a first spheroidizing 17 at 950°–1100° F., then dry blended 18 with carbon black and subjected to a second spheroidizing treatment 21 at 700°–800° F. to form spherical product 23 in which the carbon black powder 25 is completely encapsulated in the outer layer thereof.

Referring now to FIG. 2, in the process of the invention the appropriate resins, magnetic and conductive pigments and additives are intimately blended to form a molten thermoplastic toner composition on conventional hot compounding equipment 20 such as a heated kettle, banbury mixer, extruder or heated rubber mill. After complete mixing and pigment dispersion, the hot compounded toner material is cooled 22, to a brittle solid and broken into large fragments. Cooling can be accomplished in open trays, on an endless belt, on a chilled roll flaker, or by other similar means. The large fragments are fed to a hammer mill 24 for coarse grinding. The hammer mill 24 discharges a product comprising granules about ⅛" in diameter. These granules are next ground to a fine powder in fine grinder 26 by any one of standard methods such as ball milling, hammer milling, or fluid energy pulverizing. A fluid energy, or jet, pulverizer is preferred since it has no abrasive. The product does not melt and it stays in a brittle condition. A fluid energy mill operates continuously instead of batch-wise and is better equipped to pulverize a temperature-sensitive material without producing lumps or agglomerates. Suitable equipment is a Majac fluid energy mill or jet mill manufactured by the Donaldson Company, Tulsa, Okla. in which the material is fragmented by self-impact using jets of inert gas such as air or $CO_2$.

The finely ground powder has a weight average particle diameter usually in the range of 18–25 microns and is a loose free-flowing powder. In the succeeding steps, the free-flowing properties of the universal toner are enhanced.

The toner particle is next dry blended with a fine conductive pigment in conventional powder-mixing equipment 28 such as a Patterson-Kelly twin shell blender, rotating cone mixer, ribbon blender or the like. The conductive pigment is generally a carbon black having a particle diameter in the range of 10–80 millimicrons and the amount of carbon black or other conductive pigment added to the toner is between 0.5–2.0% by weight of the dry toner.

In contrast with the prior art process depicted in FIG. 1, the spheroidizing step is eliminated. The toner powder still exists as fragmentary, aspherical particles just as they were formed by the high impact, pulverizing process. There is no high temperature air dispersion process to fire polish or spheroidize the toner prior to dry blending.

After dry blending the physical, toner-carbon black mixture is subjected to a heated gas stream, preferably air, to soften the thermoplastic resin blends sufficiently to permit the much finer, conductive carbon powder to become firmly anchored to the surface of each toner particle. The adherence of the carbon powder is assured by the synergistic special combination of polyester and ethylene-vinyl acetate resins. This step is conducted in a spray dryer 30 in which the air stream is preheated to only 280°–320° F. as compared with the 700°–800° F. temperatures practiced in FIG. 1.

The final product as shown in FIG. 3 has an irregular shaped core 32 of the intimate blended mixture of toner resins, and magnetic and conductive pigments and a shell layer on which conductive carbon black powder 34 is embedded. The particles are still relatively unchanged in shape from the fragmentary appearance they acquired after being fractured in the jet pulverizing step.

DESCRIPTION OF THE PREFERRED EMBODIMENTS

The polyester component of the toner resin blend is a linear polyester having a softening point from 95° C. to 115° C. preferably from 90° C. to 110° C. The polyester is formed by the condensation of a dibasic acid with a diol. The dibasic acid may be aromatic or aliphatic, saturated or unsaturated. Representative dibasic acids are fumaric acid, maleic acid, itaconic acid, phthalic acid, adipic acid or sebacic acid.

The diol can be aliphatic or aromatic. Suitable diols are ethylene glycol, propylene glycol, neopentyl glycol, Bisphenol-A, hydrogenated Bisphenol-A and ethoxylated and propoxylated derivatives with ethylene oxide and/or propylene oxide. There are many linear polyester resins available commercially. A preferred type is the aromatic diol-unsaturated aliphatic dibasic acid type such as propoxylated Bisphenol-A fumarate polyester resin. Suitable examples of acceptable commercial polyester resins are Atlac 382 E (Atlas Division of ICI) and Hetron 700G (Durez Division of Hooker Chemicals & Plastics Corp.)

The thermoplastic polyolefin component of the toner resin is an ethylene copolymer with a vinyl comonomer such as vinyl acetate, an acrylic acid, or an acrylic ester, preferably ethylene-vinyl acetate copolymers containing from 5 to 40% vinyl acetate, preferably from 10 to 25% vinyl acetate. As the ethylene content increases, the copolymer has higher rigidity. Acceptable ethylene-vinyl acetate copolymers include Dupont's Elvax 410 and 420 and Union Carbides' EVA-303.

The two resins are blended with from 50 to 150 parts per 100 parts of resin (phr) of finely divided magnetic particles such as magnetite, barium ferrite, nickel oxide, chromium oxide, nickel zinc ferrite and the like. The resins may also be blended with from 0 to 15, preferably 2 to 10 phr, of a conductive pigment such as finely divided conductive carbon black with a particle size of 10 to 50 micrometers.

Other resins or waxes may be used as additives to modify the properties of the toner. Such properties include dielectric constant and dissipation factor, melt viscosity, frangibility, melting temperature or softening point. Such additive resins include epoxies, acrylics, polystyrenes, styrene-acrylic copolymers, and polyamides.

Similarly, other additives can be employed to modify the flow properties of the toner, namely, finely divided silica, metallic stearates, diatomaceous earth, etc. Furthermore, both the type and amount of carbon black or other conductive pigment used either in toner formulation itself or as the conductivizing material in the spray dryer can be varied to achieve different levels of conductivity or color intensity.

The following procedure represents a preferred method for manufacturing the dual purpose toner powder:

EXAMPLE 1

Thirty parts by weight of Atlac 382E (propoxylated Bisphenol-A fumarate polyester resin, softening point 94°–108° C., a product of Atlas Chemical Division of ICI), twelve parts by weight of Elvax 410 (ethylene-vinyl acetate copolymer, softening point 88° C., a product of DuPont Company), fifty-four parts by weight of Mapico Black (fine particle magnetic iron oxide, $Fe_3O_4$, or magnetite, produced by Cities Service Corporation), and four parts by weight of Vulcan XC-72R (conductive carbon black, with a particle diameter of 30 millimicrons, produced by the Cabot Corporation) are blended thoroughly in a Steward-Bolling, banbury type mixer at about 250° to 350° F. The viscous melt is then discharged and cooled to a brittle solid. This material is coarse ground in a hammer mill and then pulverized on a Majac fluid energy mill to a powder having a weight average particle diameter of 18 to 25 microns. Particle size analysis of the product show it to have less than 5% fines below 5 micrometers and less than 5% oversize particles above 30 micrometers.

98.5 parts of this powder is dry blended with 1.5 parts (by weight) of Regal 99R (carbon black with a particle diameter of 36 millimicrons, produced by the Cabot Corporation). After thorough mixing, the powder is fed by gravity, using a vibratory feeder, into the top of a Bowen spray dryer at the rate of 340 grams per minute. An inlet air temperature of 300° F. is maintained, while the exit air temperature is held at 140° F. The product is collected in a cyclone separator.

This product was tested on 3M Models VQC-I, VQC-II, and VQC-III and found to deliver excellent print quality, and good feeding (flow) characteristics. Similar results were obtained on Mita Copystar Models 700D and 900D.

One of the unexpected advantages of the dual purpose toner is the fact that it exhibits less gloss after fixing that prior art compositions. Here again, the unique combination of a polyester resin with an ethylene-vinyl acetate copolymer provides a competitive edge. Glossy images are objectionable because they reflect too much light back to the reader and reduce legibility. The toner of the invention exhibits less specular reflectance thereby appearing more dense and taking on a very desirable velvet texture.

It is to be realized that only preferred embodiments of the invention have been described and that numerous substitutions, modifications and alterations are permissible without departing from the spirit and scope of the invention as defined in the following claims.

What is claimed is:

1. A method of producing a dual purpose, single component, electronically conductive, magnetically attractable toner comprising the steps of:

heating and mixing a mixture of thermoplastic toner resins to form an intimate blend while dispersing therein 50 to 150 phr of finely divided, magnetic pigment and 0 to 15 phr of conductive pigment, said resins consisting essentially of a linear polyester consisting of the condensation product of an aromatic diol with an unsaturated aliphatic, dibasic acid having a softening point from 95° C. to 115° C. and an ethylene-vinyl acetate copolymer containing 5 to 40% vinyl acetate and the ratio of polyester to copolymer being from 1:1 to 5:1;

cooling the mixture to a brittle solid;

breaking the mixture into large fragments;

grinding the fragments to form coarse particles;

fine grinding the coarse particles to form fine, fragmentary aspherical, acicular particles having a diameter from 10 to 40 microns by subjecting the particles to jets of inert gas in absence of abrasive such that they fragment by self-impact;

dry blending the fine particles with from 0.5 to 2.0 percent by weight of finely divided conductive pigment having a particle diameter in the range of 10–80 milimicrons; and embedding the conductive pigment on the surface of the fine, acicular, aspherical particles without changing the shape thereof by gravity feeding the dry blend into the top of a spray drier and heating the falling particles in a 250°–350° F. gas stream to a temperature just sufficient to soften the thermoplastic resin.

2. A method according to claim 1 in which the gas stream is air heated to a temperature of 280° F. to 320° F.

3. A method according to claim 1 in which the ratio of polyester resin to copolymer is from 2:1 to 4:1.

4. A method according to claim 1 in which the mixture is hot compounded, cooled, crushed into large particles and then further subdivided by means of a fluid energy mill.

5. A method according to claim 1 in which the linear polyester is a condensation reaction product of a dibasic acid selected from the group consisting of fumaric acid, maleic acid, itaconic acid, phthalic acid, adipic acid or sebacic acid with a diol selected from the group consisting of ethylene glycol, propylene glycol, neopentyl glycol, Bisphenol-A, hydrogenated Bisphenol-A, and ethoxylated and propoxylated derivatives of Bisphenol A.

6. A method according to claim 5 in which the diol is a bisphenol and the acid is fumaric acid.

7. A method according to claim 6 in which the polyester is a propoxylated Bisphenol-A fumarate polyester resin.

8. A method according to claim 7 in which the ratio of polyester to copolymer is about 2.5/1.

9. A method according to claim 1 in which the magnetic pigment is magnetite and the conductive pigment is carbon black.

* * * * *